US012251745B2

(12) United States Patent
Han et al.

(10) Patent No.: US 12,251,745 B2
(45) Date of Patent: Mar. 18, 2025

(54) THIN STRIP PRODUCTION PROCESS EMPLOYING CONTINUOUS CASTING AND ROLLING

(71) Applicants: CISDI ENGINEERING CO., LTD., Chongqing (CN); CISDI RESEARCH & DEVELOPMENT CO., LTD., Chongqing (CN)

(72) Inventors: Zhiwei Han, Chongqing (CN); Qiang Liu, Chongqing (CN); Yiwen Kong, Chongqing (CN); Bitao Deng, Chongqing (CN)

(73) Assignees: CISDI ENGINEERING CO., LTD., Chongqing (CN); CISDI RESEARCH & DEVELOPMENT CO., LTD., Chongqing (CN)

( * ) Notice: Subject to any disclaimer, the term of this patent is extended or adjusted under 35 U.S.C. 154(b) by 0 days.

(21) Appl. No.: 18/003,278

(22) PCT Filed: Sep. 30, 2020

(86) PCT No.: PCT/CN2020/119494
§ 371 (c)(1),
(2) Date: Dec. 23, 2022

(87) PCT Pub. No.: WO2021/258578
PCT Pub. Date: Dec. 30, 2021

(65) Prior Publication Data

US 2023/0241656 A1 Aug. 3, 2023

(30) Foreign Application Priority Data

Jun. 23, 2020 (CN) ..... 202010581849.8

(51) Int. Cl.
*B22D 11/12* (2006.01)
*B21B 1/22* (2006.01)
*B21B 1/46* (2006.01)

(52) U.S. Cl.
CPC ..... *B21B 1/463* (2013.01); *B21B 1/227* (2013.01); *B22D 11/12* (2013.01);
(Continued)

(58) Field of Classification Search
CPC . B22D 11/12; B22D 11/1206; B22D 11/1213; B22D 11/22; B22D 11/227;
(Continued)

(56) References Cited

U.S. PATENT DOCUMENTS 5,634,257 A * 6/1997 Kajiwara et al. ..... B21B 1/26 148/541
5,904,204 A * 5/1999 Teraoka et al. .... B22D 11/1206 164/415
2012/0043049 A1* 2/2012 Klinkenberg et al. . B22D 11/14 164/474

* cited by examiner

*Primary Examiner* — Kevin P Kerns
(74) *Attorney, Agent, or Firm* — Michael D. Eisenberg

(57) ABSTRACT

A process for thin strip production integrates continuous casting and rolling, with steps including continuous casting, rough rolling, induction heating, finish rolling, laminar cooling, high-speed shearing, and coiling. A key feature is the in-line heating between casting and rough rolling, where wide surfaces, narrow surfaces, and corners of the casting blank are heated simultaneously. This process improves rough rolling efficiency, enhances uniformity and thickness stability of thin strips, reduces out-of-tolerance rates, and minimizes rolling-induced cracks.

5 Claims, 2 Drawing Sheets

(52) U.S. Cl.
CPC ..... *B22D 11/1206* (2013.01); *B22D 11/1213* (2013.01); *B21B 2001/225* (2013.01); *B21B 2267/10* (2013.01)

(58) Field of Classification Search
CPC .. B21B 1/46; B21B 1/463; B21B 1/22; B21B 1/227
USPC ..... 164/476, 417; 29/527.7
See application file for complete search history.

THIN STRIP PRODUCTION PROCESS EMPLOYING CONTINUOUS CASTING AND ROLLING

CROSS-REFERENCE TO RELATED APPLICATIONS

This application claims priority from International Patent Application Serial Number PCT/CN2020/119494, entitled "THIN STRIP PRODUCTION PROCESS EMPLOYING CONTINUOUS CASTING AND ROLLING" and filed on Jun. 30, 2020, which also claims priority to Chinese Patent Application Serial Number CN202010581849.8 and filed on Jun. 23, 2020, which are each hereby incorporated herein by reference in their respective entirety.

TECHNICAL FIELD

The invention belongs to the technical field of metallurgy and relates to a thin strip production process employing continuous casting and continuous rolling.

BACKGROUND

From 1970 to 1980, the NKK factory in Fukuyama, Japan proposed the concept of casting blank hot delivery and direct rolling which skillfully combines the two processes of casting and rolling. Compared with the traditional process that the steel casting blank is casted first, cooled and then sent to the rolling workshop, and then rolled after being heated in a heating furnace, the proposed process has the advantages of simplifying the process, improving working conditions, increasing metal yield, and saving energy.

From 1980 to 1990, the CSP of SMS and the ISP of Denmark realized industrial application whose flow charts are shown in FIG. 1 and FIG. 2. However, CSP and ISP need to cut off the casting blank before finish rolling and then enter the finish rolling machine in groups, which does not realize the continuous casting and steel rolling without intermittent connection.

In 2009, Arvedi and Voestalpine jointly developed the ESP continuous casting and rolling production line, as shown in FIG. 3, the biggest difference between this production line and CSP & ISP is that the shearing process is moved to before coiling, realizing intermittent connection of continuous casting and rolling. However, the ESP process also has deficiencies such as the press-in problem of iron oxide skin of finished hot-rolled coil, rolling warping, and uneven thickness of the rolled steel plate. The surface of the hot-rolled coil has dark brown spots, and the thickness of the steel plate is uneven, which reduces the mechanical properties and aesthetics of the finished product, which limits the application scenarios of the product and cannot exert greater economic benefits.

In order to improve the quality of finished products, the current continuous casting and rolling of thin strips are optimized on the basis of ESP.

For example, the patent CN201611064638.7 discloses a manufacturing method for thin-specification hot-rolled strip steel. Before the casting blank enters rough rolling, high-pressure water is used to remove phosphorus to eliminate iron oxide skin, and the edge is heated to make the edge temperature equivalent to the broad surface temperature of the casting blank.

For example, the patent CN201810317659.8 discloses a continuous casting and rolling technology method called CSL as shown in FIG. 4, which includes steps in sequence:

continuous casting, mechanical cleaning, rough rolling, induction heating, finish rolling, laminar cooling, high-speed shearing and finished product coiling. This process adds a mechanical cleaning process on the basis of ESP which is carried out between continuous casting and rough rolling to heat the iron oxide skin and other defects on the surface of the casting blank with a thickness of 1 mm to 5 mm to a molten state, and then use 1.5 MP~5 MP water to remove oxides in the molten state.

Compared with the original ESP, the current continuous casting production methods for producing thin strips can improve the quality of finished products to a certain extent, but in the actual production process, there are still many rolling defects, for example, compared with ESP, the patent CN201810317659.8 disclosed a continuous casting and rolling technology method which can reduce cracks and warped skin defects, but there is still a large out-of-tolerance percentage of thin strip thickness, and the uniformity of thin strip needs to be improved. Also, the thickness of the finished product of the thin strip is still difficult to control, and there are still many cracks on the surface of the thin strip.

INVENTION CONTENT

In view of this, the object of the present invention is to provide a thin strip production process employing continuous casting and continuous rolling which improves the uniformity of finished thin strips, reduces the out-of-tolerance percentage, improves the thickness stability of the finished thin strips, and further reduces rolling-induced cracks of the thin strips.

To achieve the above purpose, the present invention provides the following technical solution:

A thin strip production process employing continuous casting and continuous rolling, which sequentially includes continuous casting, rough rolling, induction heating, finish rolling, laminar cooling, high-speed shearing and finished product coiling; the process further comprises performing in-line heating between the continuous casting and the rough rolling that wide surfaces, narrow surfaces and corners of a casting blank are heated simultaneously during the in-line heating.

Further, during the in-line heating, temperature rises are controlled throughout the casting blank, so that the temperatures of wide surfaces and narrow surfaces of the casting blank are increased by more than 10° C., and the temperatures of corners of the casting blank are increased by more than 20° C.

Further, during the in-line heating, the temperature rises of the wide surfaces of the casting blank are higher than the temperature rises of the narrow surfaces of the casting blank, and the temperature rises of the corners of the casting blank are higher than the temperature rises of the wide surface of the casting blank.

Further, the process carries out process control on each step:

in process of continuous casting, casting speed of the continuous casting is greater than 4 m/min, thickness of the casting blank at exit of crystallizer is greater than 80 mm, the thickness of the casting blank at exit of fan-shaped section is greater than 78 mm, and surface temperature of the casting blank at exit of continuous casting machine is greater than 900° C.;

rough rolling reduction rate is greater than 10%;

temperature of the casting blank is heated to 1000° C.~1100° C. in the induction heating process;

the casting blank after induction heating enters finish rolling process, and thickness of thin strip produced by finish rolling is greater than 0.5 mm;

the thin strip is cooled to the coiling temperature by laminar flow;

the thin strip is cut by high-speed shearing;

the thin strip is coiled to finished product.

Further, the process also includes iron oxide skin cleaning between continuous casting process and in-line heating process.

Further, when cleaning the iron oxide skin, method of mechanical cleaning is used to heat the iron oxide skin and other defects on the surface of the casting blank with a thickness less than 5 mm to a molten state, and then use water not less than 10 MP to remove the oxides in the molten state.

The present invention effectively reduces the requirements for rough rolling equipment, improves the efficiency of the rough rolling, improves the uniformity of finished thin strips, reduces the out-of-tolerance percentage, improves the thickness stability of the finished thin strips, and further reduces rolling-induced cracks of the thin strips.

Other advantages, objectives and features of the present invention will be illustrated in the following description to some extent, and will be apparent to those skilled in the art based on the following investigation and research to some extent, or can be taught from the practice of the present invention. The objectives and other advantages of the present invention can be realized and obtained through the following description.

DESCRIPTION OF DRAWINGS

To enable the purpose, the technical solution and the advantages of the present invention to be more clear, the present invention will be preferably described in detail below in combination with the drawings, wherein.

Figure 1:
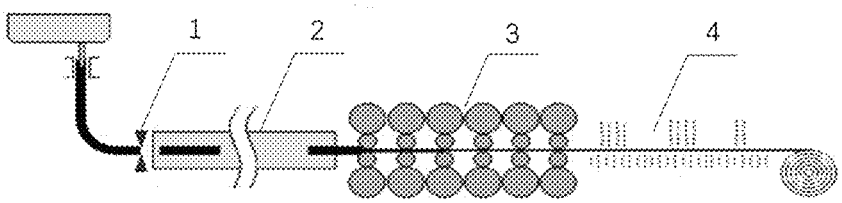
Fig. 1 (Prior Art)
FIG. 1 is the CSP process flow chart.
Figure 2:
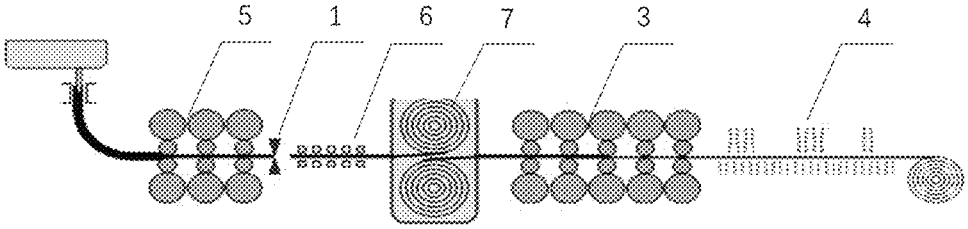
Fig. 2 (Prior Art)
FIG. 2 is the ISP process flow chart.
Figure 3:
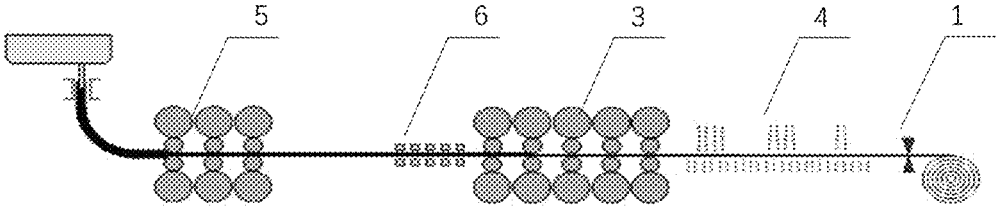
Fig. 3 (Prior Art)
FIG. 3 is the ESP process flow chart.
Figure 4:
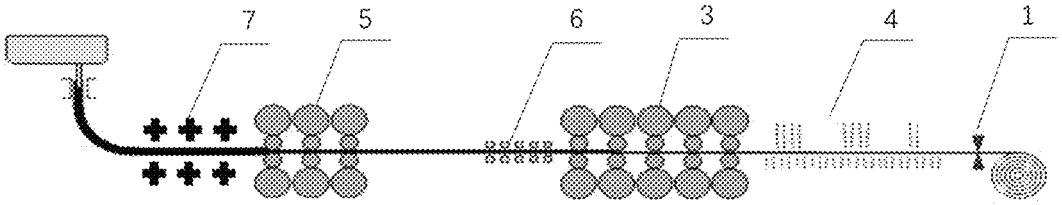
Fig. 4 (Prior Art)
FIG. 4 is the CSL process flow chart.
Figure 5:
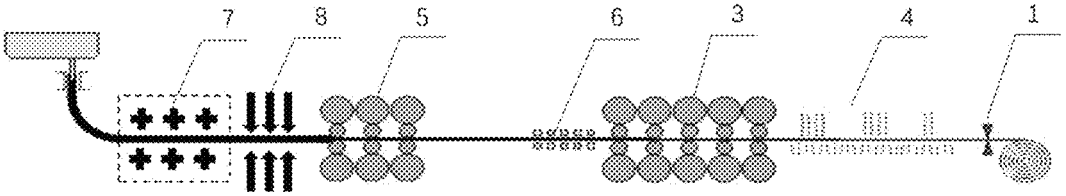
FIG. 5 is the flow chart of the thin strip production process (CSLA) of the present invention.

In the FIG.: 1—flame cutting/high-speed shearing; 2—tunnel heating furnace; 3—finish rolling; 4—laminar cooling; 5—rough rolling; 6—induction heating; 7—mechanical cleaning; 8—in-line heating.

DETAILED DESCRIPTION

Embodiments of the present invention are described below through specific embodiments. Those skilled in the art can understand other advantages and effects of the present invention easily through the disclosure of the description. The present invention can also be implemented or applied through additional different specific embodiments. All details in the description can be modified or changed based on different perspectives and applications without departing from the spirit of the present invention. It should be noted that the figures provided in the following embodiments only exemplarily explain the basic conception of the present invention, and if there is no conflict, the following embodiments and the features in the embodiments can be mutually combined.

A thin strip production process employing continuous casting and continuous rolling, which sequentially includes continuous casting, rough rolling, induction heating, finish rolling, laminar cooling, high-speed shearing and finished product coiling; the process further comprises performing in-line heating between the continuous casting and the rough rolling that wide surfaces, narrow surfaces and corners of a casting blank are heated simultaneously during the in-line heating.

In the continuous casting and rolling thin strip production process of the present invention, by adding an in-line heating process between the continuous casting process and rough rolling process, the wide surfaces, narrow surfaces and corners of the casting blank are heated at the same time, so that the surface temperature of the casting blank entering the preliminary rolling process is increased. When the casting blank enters the initial rolling process, because the temperature of the casting blank surface is increased, the forming efficiency gets higher during rough rolling, and the requirements for rough rolling equipment get lower. The thickness of every part of the final formed thin strip is uniform. Namely, the thickness of the thin strip is easier to control, and there are fewer cracks on the surface of the thin strip.

In some embodiments, during the in-line heating, temperature rises are controlled throughout the casting blank, so that the temperatures of wide surfaces and narrow surfaces of the casting blank are increased by more than 10° C., and the temperatures of corners of the casting blank are increased by more than 20° C., which can further reduce the thinness out-of-tolerance percentage of every part of the final formed thin strip. The uniformity of the thin strip is further improved, and the cracks are further reduced.

In some embodiments, during the in-line heating, the temperature rises of the wide surfaces of the casting blank are higher than the temperature rises of the narrow surfaces of the casting blank, and the temperature rises of the corners of the casting blank are higher than the temperature rises of the wide surface of the casting blank, which can further improve the uniformity of the thin strip and reduction of cracks on the surface of the thin strip.

In some embodiments, the process carries out process control on each step:

in process of continuous casting, casting speed of the continuous casting is greater than 4 m/min, thickness of the casting blank at exit of crystallizer is greater than 80 mm, the thickness of the casting blank at exit of fan-shaped section is greater than 78 mm, and surface temperature of the casting blank at exit of continuous casting machine is greater than 900° C.;

rough rolling reduction rate is greater than 10%;

temperature of the casting blank is heated to 1000° C.~1100° C. in the induction heating process;

the casting blank after induction heating enters finish rolling process, and thickness of thin strip produced by finish rolling is greater than 0.5 mm;

the thin strip is cooled to the coiling temperature by laminar flow;

the thin strip is cut by high-speed shearing;

the thin strip is coiled to finished product.

In some embodiments, the process also includes iron oxide skin cleaning between continuous casting process and in-line heating process. At this time, the iron oxide skin layer is cleaned first, then in-line heating is carried out, and then rough rolling is carried out. The in-line heating process is carried out after the iron oxide skin layer is cleaned. If the temperature of the casting blank is lowered during the iron oxide skin layer cleaning process, in-line heating can raise the temperature of the casting blank that makes the temperature of the casting blank entering the rough rolling gets high enough, which is conducive to reducing the defects of the final formed thin strip.

In some embodiments, when cleaning the iron oxide skin, method of mechanical cleaning is used to heat the iron oxide skin and other defects on the surface of the casting blank with a thickness less than 5 mm to a molten state, and then use water not less than 10 MP to remove the oxides in the molten state. Of course, in the actual implementation process, it is also possible to use high-pressure water to remove phosphorus to eliminate the iron oxide skin layer, but the method of mechanical cleaning first heating and then cleaning is more conducive to making the temperature of the casting blank entering the rough rolling higher, which is conducive to reducing defects of the final formed thin strip.

In an exemplary embodiment, the thin strip production process of continuous casting and rolling in a steel plant is specifically as follows:

S1: The casting speed of the continuous casting is 6 m/min, the thickness of the casting blank exiting the mold is 110 mm, the casting blank is compressed by 10 mm when it passes through the casting strand guide section, and the casting blank size is 100 mm×1500 mm when it exits the casting machine, and the surface temperature of the exit casting blank of the casting machine is 950° C.;

S2: The casting blank is mechanically cleaned in-line, and the 2 mm iron oxide skin layer and other defects on the surface of the casting blank are heated to a molten state, and then 2 MP water is used to remove the oxides in the molten state;

S3: by flame heating, the surface temperatures of the wide surfaces of the casting blank are increased by 50° C., the surface temperatures of the narrow surfaces are increased by 40° C., and the temperatures of the corners are increased by 80° C.

S4: The casting blank enters rough rolling, the rough rolling is a 3-stand rolling mill, and the rough rolling reduction rate is 50%;

S5: The rough rolling slab enters induction heating, and the temperature of the casting blank is heated to 1050° C.;

S6: The heated rough rolling slab enters the finish rolling, and the thickness of the thin strip produced by the finish rolling is 0.8 mm;

S7: The thin strip is cooled to the coiling temperature by laminar flow cooling, about 660° C.;

S8: Cut the thin strip through high-speed shearing;

S9: Coiling the thin strip to the thin strip roll;

When the steel plant originally produced hot-rolled strip steel with a thickness of 0.8 mm, it adopted a continuous casting and rolling process disclosed in Patent CN201810317659.8, and the rolling defect rate (including warpage, cracks, etc.) was about 5%, and the thickness control of hot-rolled strip steel is unstable, and the out-of-tolerance percentage is greater than 20%. When the thin strip is rolled by the above-mentioned production process, the rolling defect rate is reduced to 2%, and the out-of-tolerance percentage is reduced to 10%.

The above descriptions are only examples of the invention, and are not used to limit the protection scope of the invention. For those skilled in the art, the application can have various modifications and changes. Any modification, equivalent replacement, improvement, etc. made within the spirit and principle of this invention shall be included in the protection scope of this invention.

The invention claimed is:

1. A thin strip production process employing continuous casting and continuous rolling, which sequentially includes:

continuous casting, which comprises casting molten steel directly into blank via a continuous casting machine;

rough rolling, which comprises passing a heated blank through a roughing mill to reduce its thickness and make it more uniform;

induction heating, which comprises reheating the blank using an induction heating device;

finish rolling, which comprises passing the blank through rollers to further reduce its thickness to meet final specifications as a thin strip;

laminar cooling, which comprises uniformly cooling the thin strip using a laminar cooling device;

high-speed shearing, which comprises cutting the thin strip to required length using a flying shear; and finished product coiling, which comprises coiling cut thin strip into rolls;

wherein the process further comprises performing in-line heating between the continuous casting and the rough rolling, by heating wide surfaces, narrow surfaces, and corners of a casting blank simultaneously during the in-line heating;

wherein, during the in-line heating, control temperature rises throughout the casting blank to make temperature rises of corners of the casting blank higher than temperature rises of the wide surfaces and the narrow surfaces of the casting blank, so that temperatures of the wide surfaces and the narrow surfaces of the casting blank are increased by more than 10° C., and temperatures of the corners of the casting blank are increased by more than 20° C.

2. The thin strip production process employing continuous casting and continuous rolling according to claim 1, characterized in that, during the in-line heating, the temperature rises of the wide surfaces of the casting blank are higher than the temperature rises of the narrow surfaces of the casting blank, and the temperature rises of the corners of the casting blank are higher than the temperature rises of the wide surface of the casting blank.

3. The thin strip production process employing continuous casting and continuous rolling according to claim 1, characterized in that, the process carries out process control on each step:

in a process of continuous casting, casting speed of the continuous casting is greater than 4 m/min, and surface temperature of the casting blank at an exit of the continuous casting machine is greater than 900° C.;

rough rolling reduction rate is greater than 10%;

temperature of the casting blank is heated to 1000° C.~1100° C. in the induction heating process;

the casting blank after induction heating enters a finish rolling process, and thickness of thin strip produced by finish rolling is greater than 0.5 mm;

the thin strip is cooled to a coiling temperature by laminar flow;

the thin strip is cut by high-speed shearing; and the thin strip is coiled to finished product.

4. The thin strip production process employing continuous casting and continuous rolling according to claim 1, characterized in that, the process also includes iron oxide skin cleaning between continuous casting process and in-line heating process.

5. The thin strip production process employing continuous casting and continuous rolling according to claim 4, characterized in that, when cleaning an iron oxide skin, a method of mechanical cleaning is used to heat the iron oxide skin and other defects on the surface of the casting blank with a thickness less than 5 mm to a molten state, and then use water not less than 10 MP to remove oxides in a molten state.

* * * * *